US011148875B2

(12) United States Patent
Cailleaux

(10) Patent No.: US 11,148,875 B2
(45) Date of Patent: Oct. 19, 2021

(54) CONTAINER INCLUDING COVER FILM AND RECEPTACLE

(71) Applicant: PHILIP MORRIS PRODUCTS S.A., Neuchâtel (CH)

(72) Inventor: Timothee Cailleaux, Divonne-les-Bains (FR)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 16/335,078

(22) PCT Filed: Sep. 20, 2017

(86) PCT No.: PCT/IB2017/055701
§ 371 (c)(1),
(2) Date: Mar. 20, 2019

(87) PCT Pub. No.: WO2018/055525
PCT Pub. Date: Mar. 29, 2018

(65) Prior Publication Data

US 2019/0210793 A1 Jul. 11, 2019

(30) Foreign Application Priority Data

Sep. 23, 2016 (EP) ..... 16190489

(51) Int. Cl.
*B65D 85/10* (2006.01)
*A24F 15/18* (2006.01)

(52) U.S. Cl.
CPC ..... *B65D 85/109* (2013.01); *A24F 15/18* (2013.01)

(58) Field of Classification Search
CPC ..... A24F 15/10; A24F 15/18; A24F 15/20; A24F 15/08; A24F 17/00; A24F 15/00; B65D 85/109; B65D 85/14; B65D 85/12; B65D 85/1081; B65D 85/1063
USPC ..... 206/85–88, 90–94, 96, 107, 245, 274, 206/271, 275
See application file for complete search history.

(56) References Cited

U.S. PATENT DOCUMENTS 2,281,058 A * 4/1942 Winterbourne ..... B65D 85/109 206/94
2,506,832 A 5/1950 Henson
(Continued)

FOREIGN PATENT DOCUMENTS

CN 104114464 10/2014
DE 1704727 U 8/1955
(Continued)

OTHER PUBLICATIONS

Extended European Search Report for EP 16190489.1, issued by the European Patent Office dated Feb. 13, 2017; 5 pgs.
(Continued)

*Primary Examiner* — Rafael A Ortiz
(74) *Attorney, Agent, or Firm* — Mueting Raasch Group

(57) ABSTRACT

A container includes a housing and a cover film. The housing extends along a longitudinal axis and includes an outer surface. The container also includes a cover film that encloses the housing on one or more sides on the outer surface of the housing. The cover film includes a covering portion and a receiving portion. The receiving portion forms a receptacle that is adapted to receive an accessory.

13 Claims, 3 Drawing Sheets

(56) References Cited

U.S. PATENT DOCUMENTS

| | | | | | |
|---|---|---|---|---|---|
| 2,725,979 | A * | 12/1955 | Smith | A24F 15/18 206/94 |
| 3,064,799 | A * | 11/1962 | Butler | A24F 15/18 206/246 |
| 3,241,738 | A * | 3/1966 | Freiman | B65D 5/38 229/120.011 |
| 4,836,366 | A | 6/1989 | Mikhail | |
| 6,092,647 | A * | 7/2000 | Yeh | F23Q 2/32 206/217 |
| 6,119,852 | A | 9/2000 | Focke et al. | |
| 6,223,891 | B1 | 5/2001 | Devens et al. | |
| 6,430,782 | B1 * | 8/2002 | Torres | A24F 15/18 206/87 |
| 8,162,136 | B2 * | 4/2012 | McKenzie | A24F 23/04 206/242 |
| 2011/0042249 | A1 * | 2/2011 | Guerrera | B65D 77/003 206/274 |
| 2015/0034509 | A1 | 2/2015 | Seyfferth De Oliveira | |

FOREIGN PATENT DOCUMENTS

| | | | | |
|---|---|---|---|---|
| DE | 29613167 | U1 | 3/1997 | |
| DE | 202014102668 | U1 | 9/2014 | |
| EP | 0861791 | A1 * | 9/1998 | B65D 33/1691 |
| EP | 0861791 | A1 | 9/1998 | |
| EP | 0960832 | A1 | 12/1999 | |
| EP | 1155974 | A1 * | 11/2001 | A24F 17/00 |
| EP | 2292520 | A1 | 3/2011 | |
| FR | 2 697 139 | A1 | 4/1994 | |
| RU | 137972 | U1 | 12/2014 | |
| WO | WO 2008/104616 | A1 | 9/2008 | |

OTHER PUBLICATIONS

International Search Report and Written Opinion for PCT/IB2017/055701, issued by the European Patent Office dated Jan. 5, 2018; 11 pgs.

Written Opinion of the International Preliminary Examining Authority for PCT/IB2017/055701, issued by the European Patent Office dated Aug. 30, 2018; 6 pgs.

International Preliminary Report on Patentability, for PCT/IB2017/055701, issued by the European Patent Office dated Nov. 26, 2018; 17 pgs.

Russian Office Action and Search Report for RU 2019107785 issued by the Russian Patent Office, dated Nov. 23, 2020; 11 pgs. including English Translation.

Chinese Office Action for CN 201780054219.1 issued by the Chinese Patent Office, dated Jun. 10, 2021; 12 pgs. including English Translation.

* cited by examiner

CONTAINER INCLUDING COVER FILM AND RECEPTACLE

This application is the § 371 U.S. National Stage of International Application No. PCT/IB2017/055701, filed 20 Sep. 2017, which claims the benefit of European Application No. 16190489.1, filed 23 Sep. 2016, the disclosures of which are incorporated by reference herein in their entireties.

The present disclosure relates to a container for consumer goods that includes a housing, a cover film that at least partially covers the housing, and a receptacle that is connected to the cover film and is adapted to contain an accessory. The container of the present disclosure finds particular application as a container for housing smoking articles.

It is known to package elongate smoking articles and other consumer goods in containers formed from folded laminar blanks. Elongate smoking articles, such as cigarettes and cigars, are commonly sold in hinge-lid packs having a box for housing the smoking articles and a lid connected to the box about a hinge line extending across the back wall of the container. Such packs are typically constructed from one-piece laminar cardboard blanks. In use, the lid is pivoted about the hinge line to open the pack and so gain access to the smoking articles held in the box.

It is also known to provide a receptacle that can be attached to a container, where the receptacle is configured to house a lighter or other accessories. For example, U.S. Pat. No. 6,223,891 describes a package that includes a container for consumer goods and a cigarette lighter receptacle disposed on an outer surface of a wall of the container. Such receptacle, however, is formed integrally with the container from a single sheet or strip of paper or cardboard. Formation of the receptacle, therefore, requires additional manufacturing steps to fold and attach the portion of the cardboard to the container to form the receptacle in an area of today's packaging machines where space is scarce. Further, such receptacle can be bulky and add additional weight to the package.

US 2 281 058 A discloses a cellophane cigarette package outer wrapper with a folded pocket for receiving a matchbook or a plurality of matches. The document discloses three methods of creating the pocket. The first involves folding a section of the cellophane upwards from the bottom and attaching this section to the sides of the package via side sections. The second involves folding a section upwardly from the bottom and then back down to create a double-thickness pocket which is attached via side sections. The third involves folding an intermediate section of the wrapper upwardly and then downwardly over itself to form a pocket which has side sections attached to the sides of the package.

One object of the disclosure is to provide a novel container having a receptacle that is adapted to contain or house an accessory, for example, a lighter. In particular, it would be desirable to provide a novel container comprising a housing, a cover film disposed on an outer surface of the housing, and a receptacle, where the receptacle is light weight.

In one aspect of the present disclosure, a container is described. The container can be a container for consumer goods. The container includes a housing that extends along a longitudinal axis, where the housing includes an outer surface. The container also includes a single piece cover film that encloses the housing on all sides on the outer surface of the housing. The cover film includes a covering portion and a receiving portion. The receiving portion forms a receptacle that includes an inner surface and an outer surface. The receptacle is adapted to receive an accessory.

According to the invention, advantageously, because the receptacle is made from the cover film, there is no need to provide additional material during the packaging process. Therefore, the additional feature of the receptacle can advantageously be formed without the need to provide additional feeding mechanisms in the machine that can take up valuable space. Also, the stock keeping of additional material can be avoided. The receptacle of the container can allow a user to keep one or more accessories together with the container without the need for an additional device or pouch that is attached to the container. Due to the relatively thin cover material typically used, when the receptacle is empty, the part of the cover film that forms the receptacle can be conveniently folded onto the pack without adding significantly to the overall dimensions of the pack, for example, in a consumers pocket or even when disposed in a carton with additional containers or when the container is in use. In addition, as the receptacle is provided by the cover film, such receptacle may be perceived as substantially weightless.

The present disclosure is applicable to any suitable container for consumer goods that includes an inner package and a cover film. Accordingly, in one or more embodiments, the container further includes the consumer goods, where the consumer goods are housed in the interior volume defined by the inner package. Preferably, the consumer goods are smoking articles. It is known to package consumer goods such as, for example, elongate smoking articles in containers formed from folded laminar blanks. For example, elongate smoking articles, such as cigarettes and cigars, are commonly sold in hinge-lid packs having a box for housing the smoking articles and a lid connected to the box. The box may include a front wall, a left side wall, a right side wall, a rear wall, and a bottom wall. The lid may include a front wall, a left side wall, a right side wall, a rear wall, and a top wall.

The consumer goods within the container may be wrapped in an inner liner. The inner liner and consumer goods together form an inner package. The container can also include one or more inner frames disposed in any suitable location within the container. An inner frame can be disposed between the inner package and the front wall of the box or within the inner package. In one or more embodiments, a first inner frame is disposed between the inner package and the front wall of the box and a second inner frame is disposed within the inner package. Prior to first opening, the filled container may be completely wrapped and sealed in an outer wrapper formed from a cover film as is further described herein.

The container includes the housing and the cover film. The housing extends along a longitudinal axis. The housing may take any suitable form for holding consumer goods. For example, the housing may be a hinge-lid container having one or more hinged lids connected to a box housing the consumer goods. In one or more embodiments, the housing may be a slide and shell container having an inner slide for housing the consumer goods mounted within an outer shell. Where the housing is a slide and shell container, the outer shell or the inner slide may include one or more hinge lids. The housing, inner frame, inner package, and cover film may be formed from any suitable materials including, but not limited to, cardboard, paperboard, plastic, metal, or combinations thereof. The cardboard may have a weight of between about 100 grams per square meter and about 350 grams per square meter.

In one or more embodiments, the housing may have a non-rectangular transverse cross section, for example, polygonal such as triangular or hexagonal, or oval, semi-oval, circular or semi-circular.

Housings according to the disclosure find particular application as packs for elongate smoking articles such as, for example, cigarettes, cigars or cigarillos. It will be appreciated that through appropriate choices of the dimensions thereof, housings according to the disclosure may be designed for different numbers of conventional size, king size, super-king size, slim or super-slim cigarettes.

Through an appropriate choice of the dimensions thereof, housings according to the disclosure may be designed to hold different total numbers of smoking articles, or different arrangements of smoking articles. For example, through an appropriate choice of the dimensions thereof, housings according to the disclosure may be designed to hold a total of between ten and thirty smoking articles.

As well as housing a bundle of smoking articles, the housing may further include other consumer goods, for example, matches, lighters, extinguishing means, breath fresheners, or electronics. Other consumer goods may be attached to the outside of the housing, contained within the housing along with the smoking articles, in a separate compartment of the housing, disposed within the receptacle, or combinations thereof.

According to the invention, the housing has an inner surface and an outer surface. In embodiments of the invention where the container is cuboid, the housing also has a rear wall, a front wall, first and second side walls, and a bottom wall. The housing can be described by a circumferential length. The circumferential length of the housing is the length around the entire housing, for example, in a transverse direction the circumferential length is the length of the cuboid container around the front wall, one side wall, the rear wall and the other side wall. The housing includes a lid and a box.

The lid of the housing is hingedly attached to the box and is adapted to be manipulated between an open position and a closed position. In the open position, the consumer can access the consumer goods disposed within the housing. The lid is hingedly attached to the box along a hinge line that extends across the rear wall of the housing. The term "hinge line" refers to a line about which the lid may be pivoted to open the housing or close the housing. A hinge line may be, for example, a fold line (for example formed by a creasing line or a scoring line) in the panel forming the back wall of the housing. The lid and box are further defined by an opening line. The opening line refers to the delineation between the lid and the box that begins at one end of the hinge line and traverses the right side of the housing, the front of the housing then the left side of the housing, or vice versa, and ends at the other end of the hinge line. The opening line can also be described as extending circumferentially around a portion of the housing. The box includes a box front wall, a box left side wall, a box right side wall, a box back wall, and a box bottom wall. The lid includes a lid front wall, a lid left side wall, a lid right side wall, a lid back wall, and a lid top wall.

Containers according to the disclosure also include the cover film. The cover film has an inner surface and an opposing outer surface. The cover film also includes a covering portion and a receiving portion. According to the invention, the cover film is a single piece cover film where the covering portion is integral with the receiving portion. One or more regions or portions of the covering portion remain on the housing once the container has been opened. For example, the covering portion can include a lid region and a box region. The lid region is disposed over the lid of the housing, and the box region is disposed over the box of the housing. Typically, the covering portion makes up most of the cover film. Preferably, the covering portion makes up at least about 60 percent of the cover film, about 80 percent of the cover film, even more preferably at least about 90 percent of the cover film.

The cover film is generally positioned outside the housing, more specifically the inner surface of the covering portion of the cover film is disposed on the outer surface of the housing. Preferably, the inner surface of the covering portion of the cover film is affixed to or attached to at least some portion of the outer surface of the housing. In some embodiments, the inner surface of the covering portion of the cover film is affixed or attached to at least one point on the box and at least one point on the lid of the housing. Any suitable technique or combination of techniques can be utilized to affix a portion of the inner surface of the covering portion of the cover film to a portion of the box, the lid, or both. The covering portion can be attached to the outer surface of the housing, for example, by adhering it to the outer surface through use of an adhesive, by heat shrinking it around the outer surface, by ultrasonic treatment, by the use of suction features, for example YUPOTako®, by other techniques, or by any combination thereof. In one or more embodiments, the cover film can include a material or combination materials that are not heat shrinkable such that the cover film substantially retains its dimensions and structure in the presence of heat that is normally present during regular handling of the pack during and after manufacture.

The cover film can be made of any suitable materials, for example, polymeric materials, metal foils, other materials, or combinations thereof. The cover film preferably includes polymeric materials such as polyethylene films, polyolefin films, poly lactic acid films, or some combination thereof. In one or more embodiments, the cover film can be transparent. Advantageously, a transparent film does not consumer information provided on the pack or the accessory. In one or more embodiments, the cover film can have one or more opaque portions. For example, in one or more embodiments, the receiving portion of the cover film can be opaque and the covering portion of the cover film can be transparent. Further, in one or more embodiments, the cover film can include printing disposed on its outer surface, its inner surface, or both its inner and outer surface.

The cover film can include one or more layers. In one or more embodiments, the cover film may be a multilayer structure and may include at least a first layer and a second layer. In one or more embodiments, the entire cover film includes a multilayer structure. In one or more embodiments, the covering portion of the cover film is a multilayer structure and the receiving portion is a single layer structure. In one or more embodiments, the covering portion is a single layer structure and the receiving portion is a multilayer structure. The second layer can preferably form the inner surface of the cover film. Preferably, the second layer is polymeric. For example, the second layer can include polyethylene films, polyolefin films, poly lactic acid films, other polymeric films, or any combination thereof. The first layer and the second layer can be made of the same or different materials. The second layer has an inner and an outer surface. The multilayer structured cover film can include an adhesive disposed between one or more portions of the first layer and the second layer. Any suitable adhesive can be disposed between the first layer and the second layer.

The cover film can include at least one line of weakness, which can be positioned on or adjacent the opening line of the housing when the cover film is disposed on the housing.

Upon opening the container, the at least one line of weakness can be broken such that the housing opens or can be opened. Alternatively, or in addition, the cover film may be provided with a tear tape that allows a rupture in the film to propagate along a predefined direction. The tear tape can be disposed in any suitable location on or within the cover film. In one or more embodiments, the tear tape can extend from a side edge of the cover film such that the user can grasp the tear tape. The tear tape can be disposed on the cover film such that removing the tear tape will create access to the inside of the receptacle. In one or more embodiments, the receptacle is initially closed and automatically opens when the tear tape is operated, such that the receiving portion of the cover film may be partially removed to uncover the receptacle. Once the container has been opened, the covering portion can stay with the housing. Preferably, once the container has been opened, the lid region of the covering portion stays affixed or attached to at least some portion of the lid, and the box region of the covering portion stays affixed or attached to at least some portion of the box. In one or more embodiments, the lid region of the covering portion can be completely removed from the housing.

In one or more embodiments, the cover film can provide barrier properties to the container such that moisture and other environmental elements are prevented from reaching the housing or from escaping from the housing. For example, in one or more embodiments, the cover film is disposed on the housing such that the housing is completely sealed within the cover film. Further, the cover film can include a material or combination of materials that provide desired barrier properties.

According to the invention, the cover film also includes the receiving portion, wherein the receiving portion forms the receptacle. The receiving portion is integral with the covering portion of the cover film. The receiving portion can take any suitable shape or combination of shapes. In one or more embodiments, the receiving portion extends from an edge of the covering portion. The receiving portion can have a height in a direction parallel to the longitudinal axis that is the same as a height of the covering portion. In one or more embodiments, the height of the receiving portion is less than the height of the covering portion.

The receiving portion can include any suitable material or combination of materials. In one or more embodiments, the receiving portion includes the same material or materials as the material or materials of the covering portion. These embodiments are advantageous to reduce the manufacturing cost of the material and often simplifies handling, for example, when storing the film material on reels. In one or more embodiments, the receiving portion can include a material or materials that are different from the material or materials of the covering portion. These embodiments can be advantageous in that different functionality of the material can be used in different locations of the film, for example with regard to the coefficient of friction in the receiving portion or the covering portion. While handling of such material with different areas may increase production complexity of the material, this burden may be offset by simplification of the packaging process that allows handling of one film for multiple purposes.

According to the invention, the receiving portion forms the receptacle that is adapted to receive the accessory. The receptacle includes an inner surface and an outer surface. The receptacle can take any suitable shape or combination of shapes and have any suitable dimensions. The receptacle can include a top wall, a bottom wall, and a side wall that extends between the top wall and the bottom wall. In one or more embodiments, the receptacle can include two or more side walls each extending between the top wall and the bottom wall. The receptacle can include an opening disposed in the top wall such that the accessory can be disposed at least partially within the receptacle through the opening. The opening can have any suitable area. In one or more embodiments, the opening includes the same area as an area of the top wall. Further, in one or more embodiments, the receptacle can include an additional opening disposed in the bottom wall of the housing. The additional opening can have any suitable area, for example, to allow for easy access to the accessory or to prevent the accessory to inadvertently slide out of the opening. In one or more embodiments, the area of the additional opening can be the same as an area of the bottom wall of the receptacle.

The receptacle can take any suitable cross-sectional shape in a plane orthogonal to the longitudinal axis of the housing, for example, elliptical, circular, rectangular, pyramidal, polygonal, etc. In one or more embodiments, the receptacle includes a circular cross-sectional shape such that the receptacle is, at least along a certain length, a cylinder that includes an opening disposed in the top wall of the receptacle that is adapted for insertion of the accessory. In one or more embodiments, the receptacle can have a width measured in a direction orthogonal to the longitudinal axis of the housing that remains, at least along a certain length, constant in a direction parallel to the longitudinal axis between the top wall and bottom wall of the receptacle. In one or more embodiments, the cross-sectional width of the receptacle can vary along the direction parallel to the longitudinal axis such that the receptacle has one or more tapered portions.

The receptacle can have any suitable height between the top wall and bottom wall as measured in a direction parallel to the longitudinal axis. In one or more embodiments, the height of the receptacle is the same as the height of the housing. In one or more embodiments, the height of the receptacle is less than the height of the housing. Preferably, the height of the receptacle does not exceed the longest length of the box portion of the container, more preferably the height of the receptacle does not exceed the shortest length of the box portion of the container. This advantageously prevents inadvertent locking between the receptacle and the opening and closing of the lid during use.

The receptacle can be adapted to contain one or more accessories. Any suitable accessory or combination of accessories can be contained within the receptacle, for example, one or more lighters, matches, lipstick, or any other object having a substantially circular, rectangular, or elliptical cross section. The accessory can be disposed completely within the receptacle. In one or more embodiments, one or more portions of the accessory can extend through the opening disposed in the top wall of the receptacle when the accessory is disposed within the receptacle. In other words, the accessory is disposed at least partially within the receptacle.

The receptacle can be disposed in different locations relative to the housing of the container. In one or more embodiments, the receptacle is disposed adjacent the front wall of the housing. In one or more embodiments, the receptacle is disposed adjacent the first side wall or second side wall of the housing. Further, in one or more embodiments, the receptacle is disposed adjacent the rear wall of the housing. As used herein, the term "adjacent" means that that the receptacle is disposed closest to a particular wall of the housing than to any of the other walls of the housing. For example, when the receptacle is disposed adjacent the first side wall of the housing, the receptacle is disposed closer to the first side wall than to any of the front wall, rear wall, and second side wall of the housing.

The receptacle is disposed in relation to the housing such that a bottom edge of the receptacle is disposed at a first distance from a bottom edge of the housing as measured in a direction parallel to the longitudinal axis of the housing. The first distance can be any suitable distance. In one or more embodiments, the first distance is equal to 0 mm such that the bottom edge of the receptacle is flush with the bottom edge of the housing. In one or more embodiments, the receptacle is disposed such that the first distance is greater than 0 mm and no greater than 30 mm.

In one or more embodiments, one or more regions of the receiving portion of the cover film can be fused or sealed together to form the bottom wall of the receptacle. Further, in one or more embodiments, one or more regions of the receiving portion of the cover film can be fused together to form the top wall of the receptacle. Any suitable technique or combination of techniques can be utilized to fuse the region or regions of the receiving portion together to form one or both of the top wall and the bottom wall, for example, heat sealing, adhering, mechanically fastening, taping or combinations thereof. For example, in one or more embodiments, a region of the receiving portion can be fused or sealed together with a heat seal such that a fin seal is formed to provide one or both of the top wall and the bottom wall of the receptacle.

Further, in one or more embodiments, the receptacle can also include an optional attachment element disposed in any suitable location on the receptacle. In one or more embodiments, the attachment element can be disposed on an outer surface of the receptacle. The attachment element is adapted to temporarily connect the outer surface of the receptacle to the outer surface of the cover film such that the receptacle is in a folded configuration. In one or more embodiments, the attachment element can temporarily connect the outer surface of the receptacle to the outer surface of the cover film adjacent the rear wall of the container. By attaching the receptacle to the outer surface of the cover film, the receptacle becomes smaller in size such that the container with the receptacle can be packaged in a carton with multiple containers, and such that the receptacle does not become damaged or torn during packaging. Further, attachment of the receptacle to the outer surface of the cover film provides a user with the option of utilizing the receptacle to store an accessory or leave the receptacle in the folded configuration. In such an embodiment, it is particularly advantageous where the cover film is transparent, rendering the receptacle portion substantially invisible. Also advantageously, where the receiving portion is folded and attached onto the container at the end of the manufacturing process, the consumer is left with a choice whether to release the receiving portion or to ignore the receiving portion, giving the consumer optionality.

Any suitable technique or combination of techniques can be utilized to form the receptacle. For example, in one or more embodiments, a first region of the receiving portion can be connected to at least one of a second region of the receiving portion and a first region of the covering portion of the cover film using any suitable technique or combination of techniques. For example, the first region of the receiving portion can be connected to at least one of the second region of the receiving portion and the first region of the covering portion by heating sealing, adhering, mechanically fastening, or taping the regions together. In one or more embodiments, the receiving portion of the cover film can be folded over such that the first region, of the receiving portion is disposed on the outer surface of the receiving portion and is connected to the outer surface of the covering portion to form the receptacle. In one or more embodiments, the first region of the receptacle can be a portion of the inner surface of the receiving portion that is connected to the at least one of the second region of the receiving portion and the first region of the covering portion.

The receiving portion of the cover film can also include an optional retaining element or elements that aid in retaining the accessory within the receptacle. In one or more embodiments, an inner surface of the receptacle includes the retaining element. The retaining element can include any suitable element or elements that provide an increased static coefficient of friction or that can temporarily adhere the accessory to the receptacle such that the accessory is retained within the receptacle. In one or more embodiments, the retaining element can include a textured region or regions that can be disposed on the inner surface of the receptacle using any suitable technique or combination of techniques. For example, in one or more embodiments, the textured region can be provided by embossing the receiving portion of the cover film such that the inner surface of the receptacle has an embossed region or regions. The textured region or regions can have an increased or reduced static coefficient of friction, depending on the purpose of the increased or reduced static coefficient of friction on the inside of the receiving portion. In one or more embodiments, advantageously, the static coefficient of friction is increased on the inside of the receiving portion to facilitate that the accessory is retained within the receptacle. In these embodiments the textured region can have a coefficient of friction (when the material is matched with iron) of between about 0.6 and about 1.4. Preferably, in these embodiments, the static coefficient of friction of the inside of the receiving portion is higher than the static coefficient of friction of other parts of the cover film. This advantageously allows the selection of the static coefficient of friction of certain areas of the film based upon the technical requirements and machinability of the container.

In other embodiments, advantageously, the static coefficient of friction on the inside of the receiving portion is decreased to facilitate the removal of the accessory from the receptacle. In these embodiments, the textured region can have a coefficient of friction (when the material is matched with iron) of between about 0.2 and about 0.6. Preferably, in these embodiments, the static coefficient of friction of the inside of the receiving portion is lower than the static coefficient of friction of other parts or portions of the cover film. This advantageously allows the selection of the static coefficient of friction of certain areas of the film based upon the technical requirements and machinability of the container. Further, in one or more embodiments, the retaining element can include an adhesive that can be disposed on the inner surface of the receptacle. Any suitable adhesive can be utilized to provide the retaining element, for example, a pressure sensitive adhesive.

In one or more embodiments, the retaining element can include a microsuction structure disposed on the inner surface of the receptacle that can temporarily retain the accessory within the receptacle. As used herein, the term "microsuction structure" refers to an article that includes a flexible material having a plurality of micro-cavities on the material's external surface. The walls of the micro-cavities are deformable such that, when the external surface of the accessory is pressed against a contact surface of the micro-cavities, a sealed environment of reduced pressure is formed between the surface of the accessory and the walls of the cavities. Such contact provides a suction force between the walls of the cavities.

A carton that includes a lid and at least one side wall can contain one or more containers as described herein.

The term "inner surface" is used throughout the specification to refer to the surface of a component of the assembled container that is facing towards the interior of the container, for example towards the consumer goods. For example, the cover film includes an inner surface that faces the housing of the container.

The term "outer surface" is used throughout the specification to refer to the surface of a component of the container that is facing towards the exterior of the assembled container. For example, the cover film includes an outer surface that is facing away from the housing of the container. It should be noted that the inner or outer surface is not necessarily equivalent to a certain side of a blank used in assembly of the container. Depending on how the blank is folded around the consumer goods, areas that are on the same side of the container can either face towards the inside or the towards the outside of the container.

The terms "front," "back," "upper," "lower," "top," "bottom," and "side" refer to the relative positions of portions of containers according to the disclosure and components thereof when the container is in an upright position with the lid of the housing in the closed position and the hinge line at the rear of the container. When describing containers according to the present disclosure, these terms are used irrespective of the orientation of the container being described. The rear or back wall of the container includes the hinge line.

The term "integral" refers to two or more elements or components that are manufactured together as a single part. For example, the receiving portion of the cover film can be integral with the covering portion of the cover film such that the receiving portion and covering portion are manufactured together as a single film or multilayer film. In particular, an element of the container that is a single piece but comprises multiple sections, areas, or panels is considered to be "integral" under the definition above.

Referring now to the drawings, in which some aspects of the present disclosure are illustrated.

Figure 1:
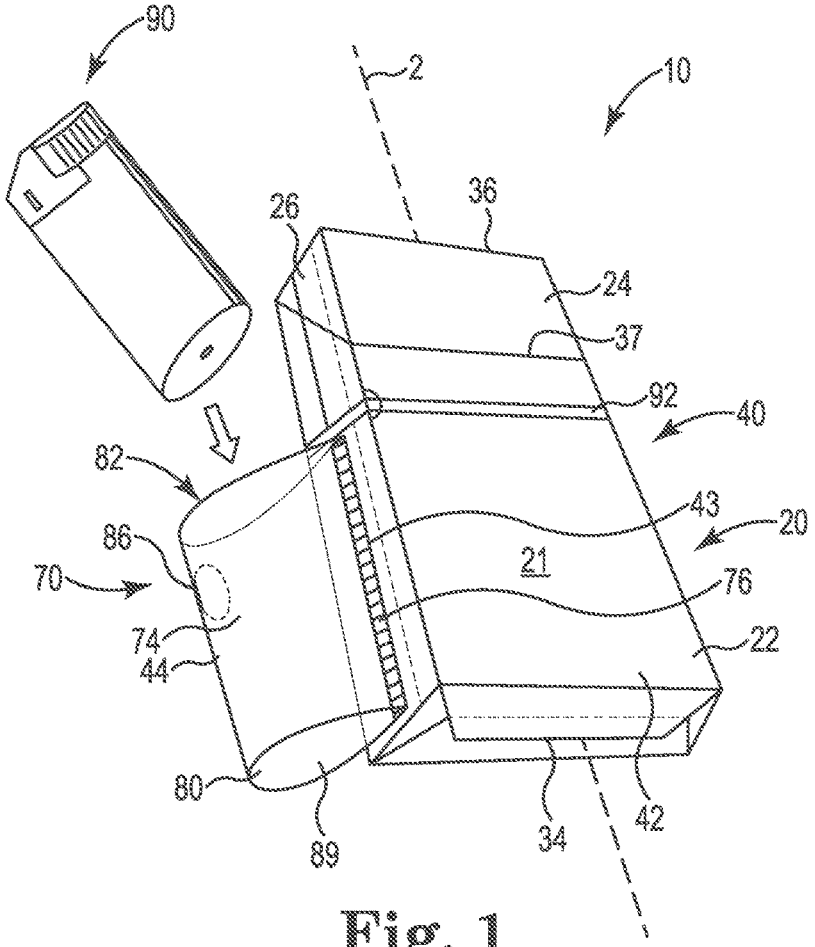
FIG. 1 is a schematic perspective view of a container that includes a housing and a cover film.
Figure 2:
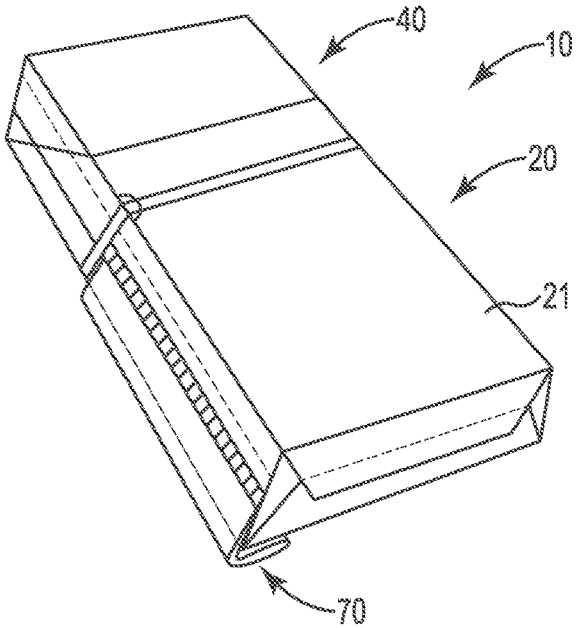
FIG. 2 is a schematic perspective view of the container of FIG. 1 with the receptacle in a folded configuration.
Figure 3:
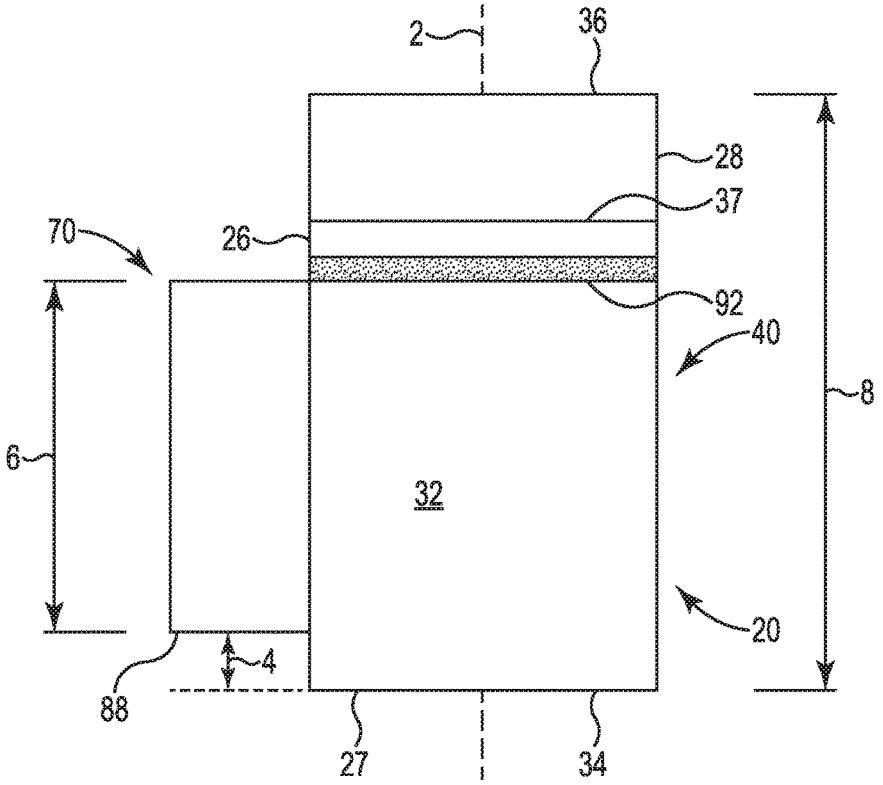
FIG. 3 is a schematic front view of the container of FIG. 1 with the receptacle in an unfolded configuration.
Figure 4:
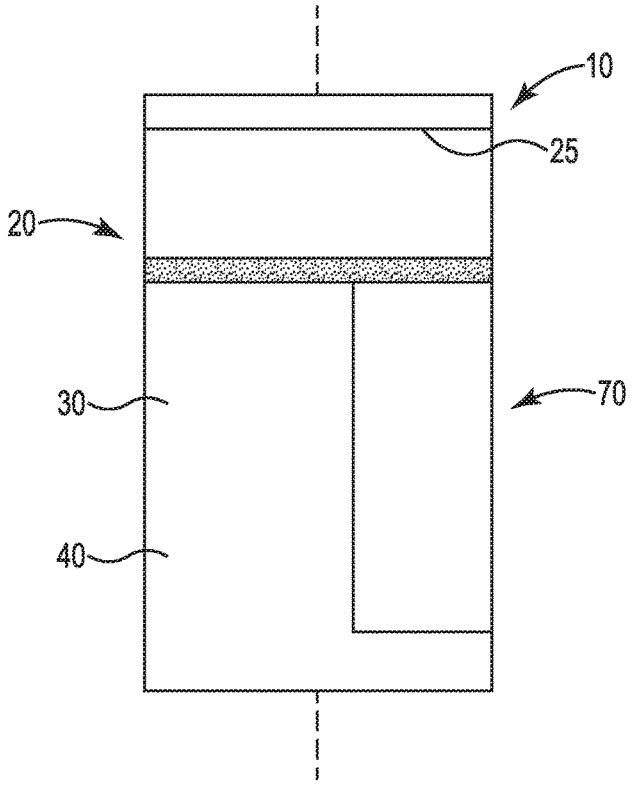
FIG. 4 is a schematic rear view of the container in FIG. 1 with the receptacle in the folded configuration.

FIGS. 1-4 are various views of one embodiment of a container 10. The container 10 includes a housing 20 having an outer surface 21, a box 22, and a lid 24 hingedly attached to the box via a hinge line 25 (FIG. 4). The housing 20 extends along a longitudinal axis 2. The hinge line 25 extends across a rear wall 30 of the box 22 of the container 10, and acts to allow the lid 24 to be moved from a closed position as shown in the figures to an open position (not shown). The housing 20 also includes a front wall 32, a rear wall 30, a first side wall 26, a second side wall 28, a bottom wall 34, and a top wall 36. The box 22 and the lid 24 are defined by an opening line 37. The hinge line 25 has two end points on the rear wall 30 of the housing 20 from which the opening line 37 begins and goes around the housing circumferentially.

The container 10 also includes a cover film 40. In one or more embodiments, the cover film 40 is a single piece cover film. In one or more embodiments, the cover film 40 includes two or more pieces. The cover film 40 encloses the housing 20 on one or more sides on the outer surface 21 of the housing. In one or more embodiments, the cover film 40 encloses the housing 20 on all sides on the outer surface 21 of the housing. Once the housing 20 has been opened, one or more portions of the cover film 40 can be removed. For example, in one or more embodiments, a lid region 46 (FIG. 5) of the covering portion 42 of the cover film 40 that covers the lid 24 can be removed while a box region 48 of the covering portion of the cover film that covers the box 22 can remain in place. Preferably, the cover film 40 is snug or tight around the housing 20 of the container 10.

The cover film 40 includes a covering portion 42 and a receiving portion 44. The receiving portion 44 of the cover film 40 forms a receptacle 70 that is adapted to receive an accessory 90, The receptacle 70 includes an inner surface 72 (FIG. 5) and an outer surface 74.

Figure 5:
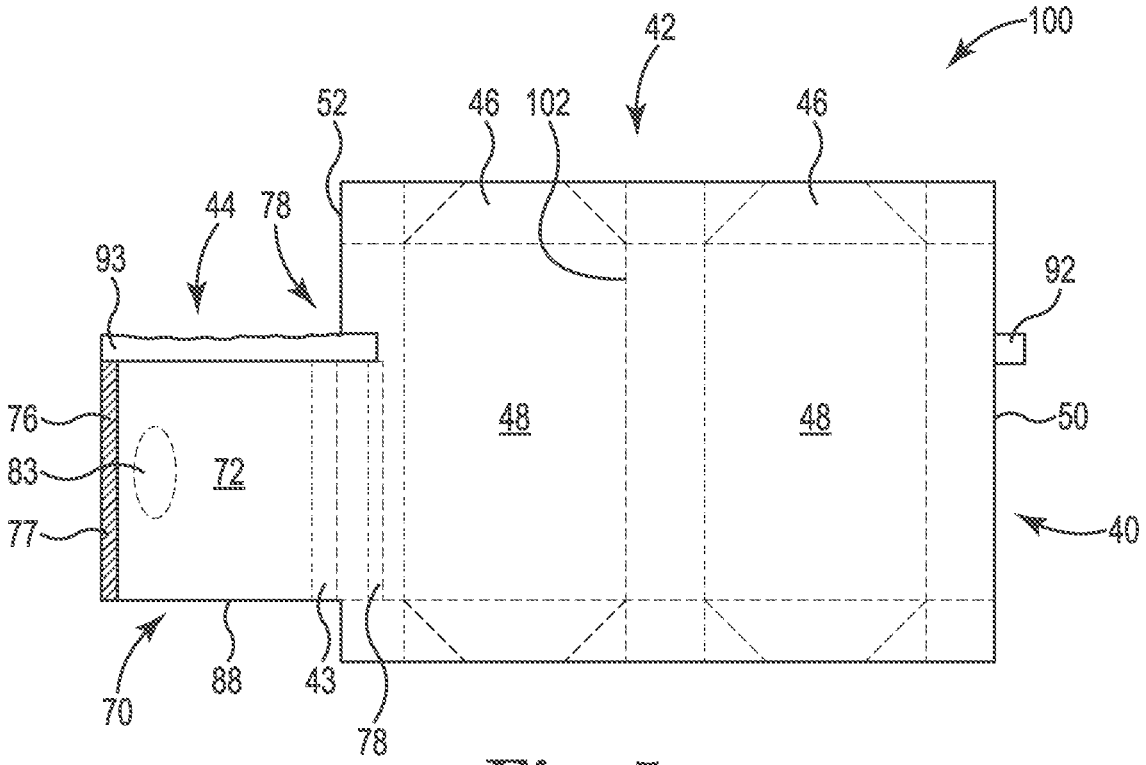
FIG. 5 is a schematic plan view of a blank that is utilized to form the cover film of the container of FIG. 1.

The receiving portion 44 of the cover film 40 includes a first region 76 that is connected to at least one of a second region 43 of the receiving portion and a first region 78 of the covering portion 42 (FIG. 5). In one or more embodiments, the first region 76 of the receiving portion 44 is connected to at least one of the second region 43 of the receiving portion and the first region 78 of the covering portion 42 by a heat seal 77.

The covering portion 42 of the cover film 40 includes the lid region 46 and the box region 48 as shown in FIG. 5. The lid region 46 is disposed over the lid 24 of the housing 20. Further, the box region 48 is disposed over the box 22 of the housing 20. The lid region 46 of the covering portion 42 includes a tear tape 92. The tear tape 92 extends from a side edge 50 of the cover film 40 as shown in FIG. 5. In one or more embodiments, the tear tape 92 is disposed on the cover film 40 such that removing the tear tape provides access to the inside of the receptacle 70.

The receptacle 70 includes a cylinder shape that includes an opening 82 disposed in a top wall (not shown) of the receptacle that is adapted for insertion of the accessory 90. The receptacle 70 also includes an attachment element 86 disposed on the outer surface 74 of the receptacle. The attachment element 86 is adapted to temporarily connect the outer surface 74 of the receptacle 70 to the outer surface 43 of the cover film 40 such that the receptacle is in a folded configuration as shown in FIGS. 2 and 4.

The receptacle 70 is disposed adjacent the first side wall 26 of the housing 20. As used herein, the term "adjacent" means that the receptacle 70 is disposed closer to the first side wall 26 than to front wall 32, rear wall 30, or second side wall 28 of the housing 20. A bottom edge 88 of the receptacle 70 is disposed at a first distance 4 from a bottom edge 27 of the housing 20 as measured in a direction parallel to the longitudinal axis 2 of the housing as can be seen in FIG. 3.

In one or more embodiments, a region 80 of the receiving portion 44 of the cover film 40 can be sealed together to form a bottom wall 89 of the receptacle 70. Any suitable technique or combination of techniques can be utilized for form the bottom wall 89 of the receptacle 70, for example, heat sealing the region 89 of the receiving portion 44 to form a fin seal (not shown).

Further, in one or more embodiments, the inner surface 72 of the receptacle 70 can include a retaining element 83 that is adapted to at least partially retain the accessory 90 within the receptacle 70. In one or more embodiments, the retaining element 83 can include a textured region that can include an increased static coefficient of friction. The textured region can have any suitable coefficient of friction. In one or more embodiments, the retaining element can include an adhesive disposed on the inner surface 72 of the receptacle 70.

The receptacle 70 includes a height 6, and the housing 20 includes a height 8 as measured in a direction parallel to the longitudinal axis 2 as is shown in FIG. 3. The height 6 of the receptacle 70 is less than the height 8 of the housing 20.

The cover film 40 can be formed from any suitable blank or preform. For example, FIG. 5 is a plan view of a blank 100 that can be utilized to form the cover film 40 of the container 10 illustrated in FIGS. 1-4. The blank 100 includes fold or score lines 102 that can be utilized to fold the blank such that it covers one or more portions of the outer surface 21 of the housing 20. As illustrated in FIG. 5, the receiving portion 44 is a panel that extends from a second side edge 52 of the cover portion 42 of the cover film 40. The receiving portion 44 can extend from the second side edge 52 of the covering portion 42 in any suitable location along such edge. The receiving portion 44 also includes a tear region 93 that can be removed from the receiving portion when the tear tape 92 is torn and removed from the cover film 20.

Figure 6:
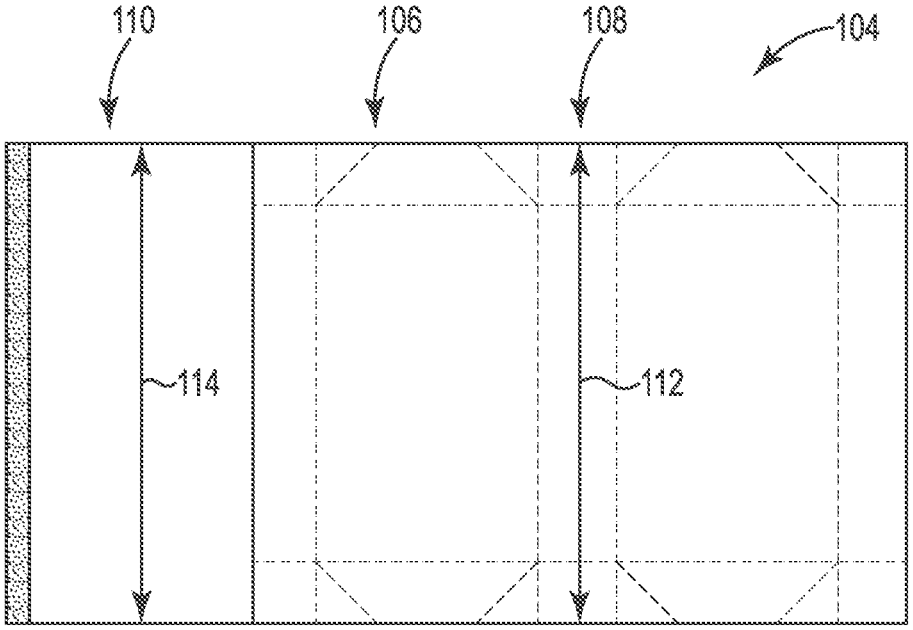
FIG. 6 is a schematic plan view of another embodiment of a blank that can be utilized to form a cover film.

FIG. 6 is another embodiment of a blank 104 that can be utilized to form a cover film 106 of a container. The cover film 106 includes a covering portion 108 and a receiving portion 110. All of the design considerations and possibilities regarding the cover film 20 of FIGS. 1-5 apply equally to the cover film 106 of FIG. 6. One difference between cover film 106 and cover film 40 is that the receiving portion 110 can have a height 114 that is the same as a height 112 of the covering portion 108.

The invention claimed is:

1. A container for consumer goods, comprising:

a housing extending along a longitudinal axis and comprising an outer surface; and a single piece cover film enclosing the housing on all sides on the outer surface of the housing, wherein the cover film comprises a covering portion and a receiving portion, wherein the receiving portion forms a receptacle that is adapted to receive an accessory, wherein the receptacle comprises an inner surface and an outer surface, wherein the receptacle further comprises an attachment element disposed on an outer surface of the receptacle, wherein the attachment element is adapted to temporarily connect the outer surface of the receptacle to an outer surface of the cover film such that the receptacle is in a folded configuration;

wherein the covering portion of the cover film comprises a lid region and a box region, wherein the lid region is disposed over a lid of the housing and the box region is disposed over a box of the housing.

2. A container according to claim 1, wherein a first region of the receiving portion is connected to at least one of a second region of the receiving portion and a first region of the covering portion.

3. A container according to claim 2, wherein the first region of the receiving portion is connected to at least one of the second region of the receiving portion and the first region of the covering portion by a heat seal.

4. A container according to claim 1, wherein the cover film further comprises a tear tape.

5. A container according to claim 4, wherein the tear tape extends from a side edge of the cover film.

6. A container according to claim 4, wherein the tear tape is disposed on the single piece cover film such that removing the tear tape will create access to the inside of the receptacle.

7. A container according to claim 1, wherein the receptacle comprises a cylinder comprising an opening disposed in a top wall of the receptacle that is adapted for insertion of the accessory.

8. A container according to claim 1, wherein the receptacle is disposed adjacent a side wall of the housing.

9. A container according to claim 1, wherein a bottom edge of the receptacle is disposed at a first distance from a bottom edge of the housing as measured in a direction parallel to the longitudinal axis of the housing.

10. A container according to claim 1, wherein the inner surface of the receptacle comprises a retaining element comprising a textured region with an increased static coefficient of friction.

11. A container according to claim 1, wherein the inner surface of the receptacle comprises a retaining element comprising an adhesive disposed on the inner surface of the receptacle.

12. A container according to claim 1, wherein the receptacle comprises a height that is less than a height of the housing as measured in a direction parallel to the longitudinal axis.

13. A container according to claim 1, wherein a region of the receiving portion of the cover film is sealed together to form a bottom wall of the receptacle.

* * * * *